US005193105A

United States Patent [19]

Rand et al.

[11] Patent Number: 5,193,105

[45] Date of Patent: Mar. 9, 1993

[54] ION CONTROLLING ELECTRODE ASSEMBLY FOR A SCANNING ELECTRON BEAM COMPUTED TOMOGRAPHY SCANNER

[75] Inventors: Roy E. Rand, Palo Alto; Eugene Y. Tsiang, Belmont, both of Calif.

[73] Assignee: Imatron, Inc., So. San Francisco, Calif.

[21] Appl. No.: 809,924

[22] Filed: Dec. 18, 1991

[51] Int. Cl.[5] ..... H01J 35/06

[52] U.S. Cl. ..... 378/137; 378/138; 250/396 ML

[58] Field of Search ..... 378/137, 138, 145.04; 250/396 ML, 396 R, 398, 982.3

[56] References Cited

U.S. PATENT DOCUMENTS

| | | | |
|---|---|---|---|
| 4,352,021 | 9/1982 | Boyd et al. | 378/146 |
| 4,521,900 | 6/1985 | Rand et al. | 378/137 |
| 4,521,901 | 6/1985 | Rand et al. | 378/138 |
| 4,521,902 | 6/1985 | Peugeot | 378/138 |
| 4,625,150 | 11/1986 | Rand et al. | 375/111 |
| 4,644,168 | 2/1987 | Rand et al. | 250/396 ML |

*Primary Examiner*—Janice A. Howell
*Assistant Examiner*—Don Wong
*Attorney, Agent, or Firm*—Flehr, Hohbach, Test, Albritton & Herbert

[57] ABSTRACT

An electron beam scanning system employing a relatively short housing chamber wherein an electron beam is produced includes an ion controlling electrode assembly. Located in the housing between the electron gun and system beam optics, the assembly includes a generally cone-shaped rotating field ion controlling electrode (or "RICE") unit comprising cylindrically symmetrical element pairs disposed on opposite sides of the housing Z-axis. Preferably equal and opposite potential sources coupled to elements comprising an element pair create a transverse electric field therebetween. The vector sum of the fields produced by all element pairs is the transverse field created by the RICE unit. The potentials are varied, rotating the overall RICE field to controllably remove most but not all positive ions. The remaining ions improve the electron beam space-charge density, resulting in a sharply focused scanning electron beam. Preferably a disk-like positive ion electrode (or "PIE") unit coupled to a large positive potential is disposed downstream from the RICE unit to block upstream migration of positive ions. Where discontinuities are present in the housing, a periodic axial field ion controlling electrode (or "PICE") unit is disposed at the upstream end of the overall assembly. The PICE comprises spaced-apart disks alternately coupled to large and small potentials to create alternating axial fields within a short axial distance, to rapidly sweep away ions. Regions within the overall assembly not otherwise acted upon by fields are covered with one or more conventional ICE units to sweep away positive ions.

21 Claims, 7 Drawing Sheets

SPACE-CHARGE DENSITY OF ORIGINAL BEAM

POTENTIAL DUE TO ORIGINAL BEAM

POTENTIAL WITH APPLIED ELECTRIC FIELD

SOLID LINE—NO NEUTRALIZATION

DASHED LINE—WITH ASSYMMETRIC NEUTRALIZATION

EFFECTIVE SPACE-CHARGE DENSITY OF PARTIALLY NEUTRALIZED BEAM

EXAMPLE IS FOR $\phi=0$
(SEE FIG.—4)
$V_x$ IS NEGATIVE

ION CONTROLLING ELECTRODE ASSEMBLY FOR A SCANNING ELECTRON BEAM COMPUTED TOMOGRAPHY SCANNER

FIELD OF THE INVENTION

The present invention relates generally to scanning electron beam systems for X-ray production in a computed tomography X-ray transmission system, and more particularly to controlling the uniformity of the beam space-charge density, especially by means of positive ions.

BACKGROUND OF THE INVENTION

Scanning electron beam computed tomography systems are described generally in U.S. Pat. No. 4,352,021 (Boyd, et al.) issued Sep. 28, 1982. The theory and implementation of devices to help control the electron beam in such systems is described in detail in U.S. Pat. No. 4,521,900 (Rand, et al.), issued Jun. 4, 1985; U.S. Pat. No. 4,521,901 (Rand, et al.) issued Jun. 4, 1985; U.S. Pat. No. 4,625,150 (Rand, et al.) issued Nov. 25, 1986; and U.S. Pat. No. 4,644,168 (Rand, et al.) issued Feb. 17, 1987. Applicants refer to and incorporate herein by reference each above listed patent to Rand, et al.

As described in detail in U.S. Pat. No. 4,521,900 to Rand, et al. (hereafter "Rand, et al. '900"), an electron beam is produced by an electron gun at the upstream end of an evacuated generally elongated and conical shaped housing chamber (or "drift tube"). A large electron gun potential (e.g., 130 kV) accelerates the electron beam downstream along a first straight line path defining the chamber Z-axis. Further downstream a beam optical system including focus and deflection coils deflects the beam into a scanning path. The deflected beam exits the beam optical system and impinges a suitable target for producing X-rays. The X-rays penetrate an object (e.g., a person) and are then detected and computer processed to produce an X-ray image of a portion of the object. Prior art electron beam systems such as described in the above-referenced patents characteristically had relatively long conical shaped housing chambers, e.g., 3.8 meters.

Because the electrons are negatively charged, the resultant space-charge causes the electron beam to diverge or expand in the upstream chamber region between the electron gun and the focus and deflection coils. This expansion is beneficial because the beam diameter at the target varies approximately inversely with the beam diameter at the focus and deflection coils. In the chamber region downstream from the focus and deflection coils, a converging electron beam is desired. In that downstream region, the beam preferably is neutralized by positive ions produced by the electrons from residual gas in the chamber, or from a gas purposely introduced into the chamber. This neutralization causes the beam to self-focus sharply upon the target to produce a sharp X-ray image. In the ideal case, the electron beam is perfectly uniform in current density, diverging upstream and converging to sharply self-focus downstream.

Although a diverging beam is desired in the upstream chamber region, positive ions can counteract divergence. Positive ions are present because the electron beam interacts with residual gases that inevitably remain after evacuation, or with gases purposely introduced into the chamber. In the upstream chamber region, positive ions are detrimental because they tend to neutralize the space-charge, preventing electron beam divergence. This in turn increases the beam width at the target, resulting in a defocused X-ray image. Neutralization also can result in the beam becoming unstable and collapsing completely.

By contrast, positive ion neutralization can be beneficial in the chamber region downstream from the focus-deflection coils. Here neutralization eliminates the electron self-repulsion, while the beam's attractive magnetic field converges and self-focuses the beam. Elements of the beam optical system are then used to fine tune the converged beam to produce a sharp X-ray image.

Thus, while positive ions can be beneficial downstream from the focus-deflection coils, they are detrimental in the upstream region. In prior art tomography systems such as described in the Rand, et al. U.S. Pat. No. 4,521,900 patent, positive ions were removed by causing the electron beam to pass axially through an electrically biased ion clearing electrode (or "ICE") mounted in the upstream chamber region. The ICE created a relatively large transverse electric field that swept away the slow moving positive ions, without disturbing the considerably faster moving electrons. Such ICEs required large electrode potentials (e.g., about 1 kV) to produce the large electric field needed to remove ions on an "all or nothing" basis.

Ideally the electron beam should be homogenous, i.e., with a uniform electron distribution, so the beam acts as its own perfect lens: self-diverging in the upstream chamber region and self-converging in the downstream chamber region to focus sharply on the target. A uniform space-charge density is desired because any optical aberrations due to the electron beam self-forces would then be eliminated. In addition to degradation from ions, the electron beam space-charge density may not be perfectly uniform due to imperfections in the electron gun and in the beam optics system.

It is believed that the relatively long length of prior art housing chambers contributed to beam space-charge homogenization by smoothing or evening out the electron distribution. In essence, the distance between the electron gun and beam optics was sufficiently long to allow the electron beam to expand and become more uniform without requiring special mechanisms to compensate for beam non-uniformity.

For reasons of economy, maintenance and ease of installation in hospitals, it is advantageous to construct a scanning electron beam system using a housing chamber shorter than used in prior art systems. Unfortunately, however, the resultant shorter distance between the electron gun and beam optics prevents the beam from expanding sufficiently to become homogeneous. Further, the construction of shorter housing chambers may create discontinuities, typically near vacuum valve couplings and flanges. These discontinuities create gaps in the electric field generated by ion controlling devices, thus allowing some ions to remain in the upstream region where they further degrade beam expansion.

In summary, in an electron beam scanner system employing a relatively short length housing chamber, there is a need for a method and apparatus for removing positive ions, and for controlling the positive ion distribution. Such method and apparatus should compensate for beam space-charge density non-uniformity, thereby eliminating any aberrations due to the beam self-forces. Unfortunately, prior art ICEs with their "all or nothing" characteristic simply do not provide any mechanism for controlling space-charge uniformity of the electron beam, and do not remove all ions when operating over discontinuities. The present invention discloses an ion controlling electrode assembly and a method to fulfill these needs.

SUMMARY OF THE INVENTION

The present invention is a relatively short length ion controlling electrode assembly for use in a short length housing chamber in a computed tomography X-ray transmission scanning system. Because the chamber is short, the electron beam cannot adequately expand between the electron gun and beam optics. The present invention compensates for this by controllably removing some (but not necessarily all) ions, thereby adjusting the electron beam's space-charge density distribution. As a result, beam spot resolution and thus image sharpness is improved.

The electrode assembly is disposed within the vacuum housing chamber between the electron gun and the focus-deflection coils such that the electron beam passes axially through the electrode assembly along the Z-axis. The electrode assembly includes a rotatable field ion controlling electrode ("RICE") and, downstream therefrom, a positive ion electrode ("PIE"). Alternative embodiments further include an optional periodic axial field ion controlling electrode ("PICE"), located at the most upstream region of the electrode assembly, and one or more optional ion clearing electrodes ("ICEs"), located on either side of the RICE.

The RICE improves image sharpness by homogenizing the electron beam space-charge density, thereby linearizing the beam optics and eliminating aberrations. Some but not necessarily all positive ions are controllably removed by subjecting the electron beam to a small, rotatable transverse electric field generated by the RICE. The field is preferably on the same order of magnitude as the field created by the electron beam, and is rotated by varying the electrical potential coupled to the elements comprising the RICE. The electric field is adjusted until the electron beam space-charge density is homogenized, and so the scanner system's X-ray image exhibits maximum resolution or sharpness.

The RICE includes at least two pair of spaced-apart elements, an equal and opposite electrical potential preferably being coupled to each element in an element pair. The elements comprising each element pair are preferably cylindrically symmetrical to each other about the Z-axis. The RICE preferably is shaped like a cone that expands downstream such that the distance from the Z-axis to each RICE element is approximately proportional to the electron beam radius at each point. This geometry tends to make the potential along the beam's Z-axis constant. As a result, positive ions trapped within the electron beam tend not to drift axially along the Z-axis, which drift could produce severe beam optical aberrations.

The potential applied to a RICE element may be AC, DC or a combination thereof. Because a potential difference exists between the elements comprising an element pair, a transverse electric field exists therebetween. The transverse electric field generated by the RICE as a whole is the vector sum of the electric fields generated by the element pairs comprising the RICE. If the RICE electrode potentials are DC, the resultant RICE transverse field will be static, but if an AC electrode potential is present, a dynamic or rotating field mode occurs. By varying the electrode potentials, the RICE field can be rotated to control how many positive ions, if any, are allowed to remain within the RICE to modify and improve the beam space-charge uniformity. The resultant more homogenized space-charge density reduces (or eliminates) aberrations due to the electron beam, allowing for easier focusing by the scanning system's beam optical components.

In a preferred embodiment, the electrode assembly further includes a positive ion electrode ("PIE") disposed coaxially downstream from the RICE. The PIE is biased to create a large axial field that prevents upstream migration of positive ions, which migration could interfere with the production of a sharply self-focused uniform beam at the X-ray target.

In another aspect, the present invention further includes a short-length periodic axial field ion controlling electrode ("PICE"). The PICE is located adjacent the electron gun, in the upstream region of the housing chamber where small size and discontinuities preclude the effective use of a conventional ICE. The PICE comprises several spaced-apart washer-like electrodes coaxial to the Z-axis, with alternate electrodes coupled to a relatively large potential (e.g., −2 kV) relative to intermediate electrodes (e.g., 0 V). The PICE's small size allows it to operate in the upstream housing chamber region across discontinuities and thus remove positive ions from this region.

In yet another aspect, the present invention further includes first and second conventional ion clearing electrodes (ICEs), preferably coaxially disposed immediately upstream and downstream from the RICE. These ICEs are coupled to a large negative potential (e.g., −1.5 kV) to sweep away all positive ions on either side of the RICE. Essentially these ICEs may be used to control the electric field in any region of the housing chamber between the electron gun and beam optics that is not controlled by the RICE, PIE and, if present, PICE.

In summary, the present invention controls the ion distribution density within an electron beam by rotating the vector direction and strength of a relatively low magnitude transverse field created by a RICE. A PIE prevents any upstream migration of positive ions into the RICE where they could interfere with RICE operation. A PICE removes ions from the upstream region of the chamber where discontinuities are present, and conventional ICEs remove ions from regions of the chamber not controlled by the RICE, PIE or PICE. The resultant electron beam produces a controllably sharper, higher resolution X-ray image.

Other features and advantages of the invention will appear from the following description in which the preferred embodiments have been set forth in detail in conjunction with the accompanying drawings.

DESCRIPTION OF THE PREFERRED EMBODIMENTS

Figure 1:
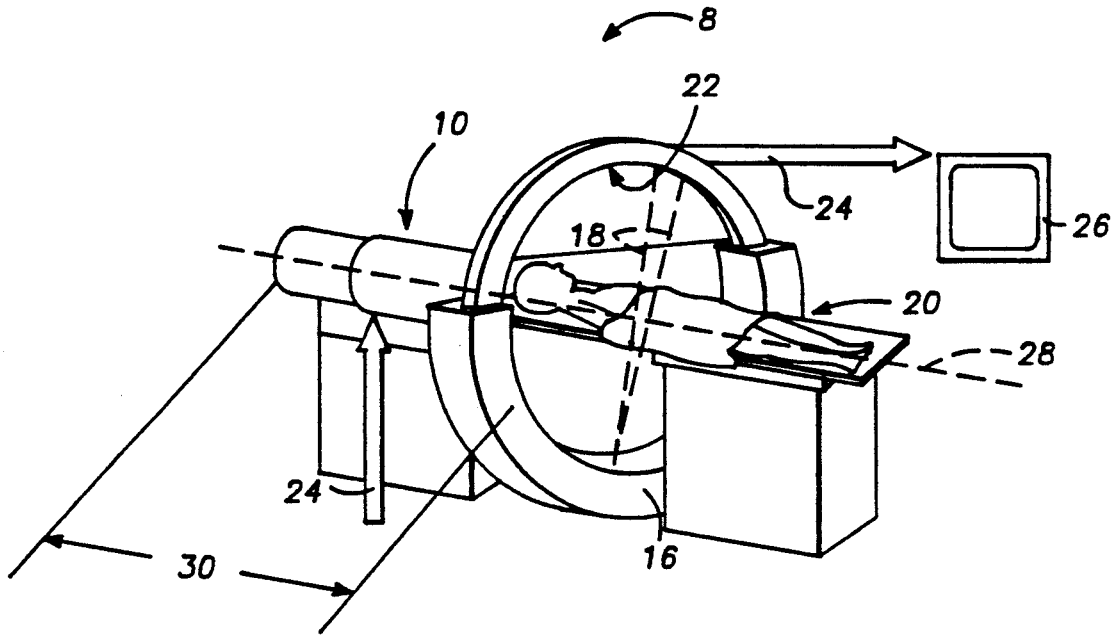
FIG. 1 depicts a generalized scanning computed tomography X-ray transmission system that uses a relatively short length vacuum housing chamber to produce and control an electron beam.
Figure 2:
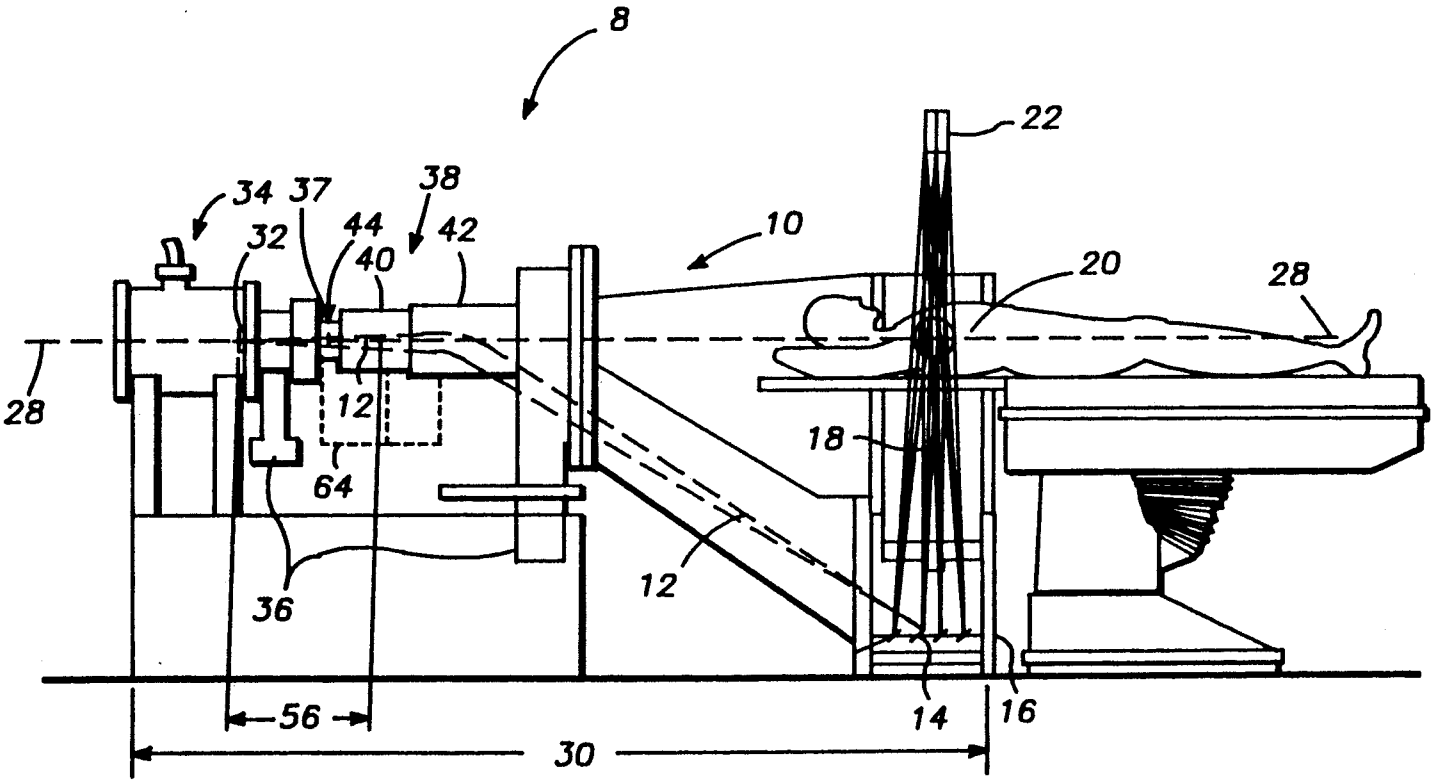
FIG. 2 is a longitudinal view of the system shown in FIG. 1.

FIG. 1 and FIG. 2 depict a generalized computed tomography X-ray transmission scanning system 8 that includes a relatively short length vacuum housing chamber 10 wherein an electron beam 12 is generated and caused to scan at least one circular target 14 located within chamber 12's front lower portion 16. When it strikes the target, the electron beam, which typically scans 210° or so, emits a moving fan-like beam of X-rays 18. X-rays 18 then pass through a region of a subject 20 (e.g., a patient or other object) and register upon a region of a detector array 22 located diametrically opposite. The detector array outputs data to a computer processing system (indicated by arrows 24) that processes and records the data to produce an image of a slice of the subject on a video monitor 26. As indicated by the second arrow 24, the computer processing system also controls the system 8 and the electron beam production therein. By repeating the scanning process after the patient has been moved laterally along the chamber Z-axis 28, a series of X-ray images representing axial "slices" of the patient's body is produced.

As shown in FIG. 2, an electron gun 32 within the extreme upstream end 34 of chamber 10 produces the electron beam 12 in response to high voltage excitation (e.g., 130 kV). Although vacuum pumps 36 evacuate chamber 10, residual gases inevitably remain that produce positive ions in the presence of the electron beam 12. Gases may also be introduced into the chamber for the purpose of producing positive ions, since the ions are beneficial in the downstream chamber region. A beam optical system 38 that includes a focus coil 40 and a deflection coil 42 is mounted downstream in chamber 10 to respectively magnetically focus and scan the beam 12 typically about 210° in an arc across an arc-like target 14.

The positive ions that are created can detrimentally neutralize the electron beam in the upstream region of chamber 10. It is important to subject the electron beam 12 to an electric field in the upstream region, but discontinuities such as 37 in the housing 10 create gaps over which conventional devices for clearing ions cannot be used. In addition, imperfections in the electron gun cause the electron beam to have a non-uniform space-charge density in a plane perpendicular to the Z-axis 28. Finally, because the drift distance between the electron gun and the beam optics 38 is relatively short, e.g., 40 cm or so, the electron beam 12 does not have time for its space-charge density to become sufficiently homogeneous. The present invention, electrode assembly 44, is designed to counteract these detriments and to ensure that the X-ray image resulting from the relatively short length computed tomography system 8 is sufficiently sharply focused and of high resolution. Assembly 44 must function within a relatively short chamber length 30, typically about 2.5 meters as contrasted with 3.8 meters for chamber lengths in scanning systems such as described in the Rand, et al. and Boyd, et al. references.

As shown in FIG. 2, electrode assembly 44 is mounted within housing 10 between the electron gun 32 and the beam optical assembly 38 such that the electron beam 12 passes axially through assembly 44 along the Z-axis 28. Ideally the Z-axis 28 is coaxial with the electron beam 12 upstream from the beam optics assembly 38 within chamber 10, and further represents the longitudinal axis of chamber 10, and the axis of symmetry for the electrode assembly 44 and the beam optics assembly 38.

Figure 3:
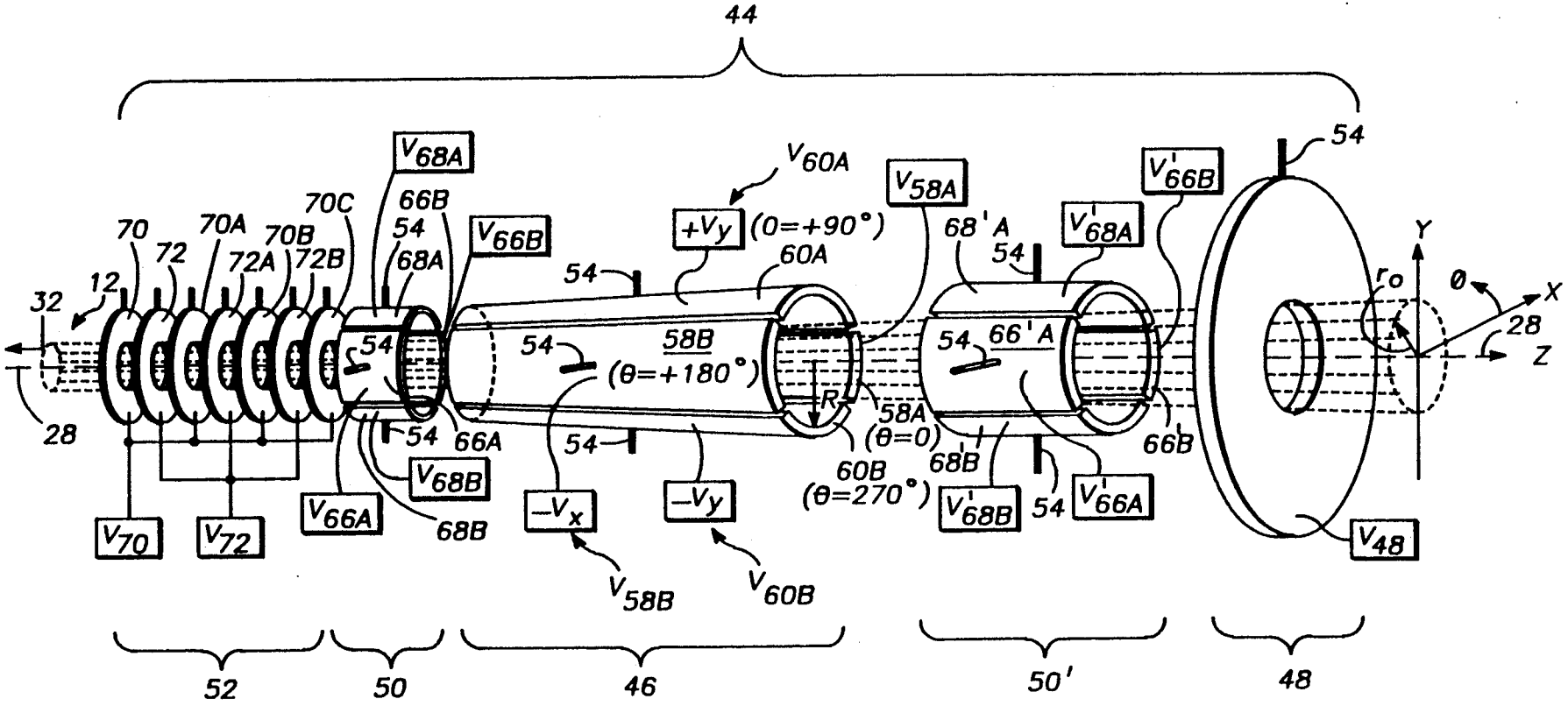
FIG. 3 is a perspective, expanded view of the ion electrode assembly shown in FIG. 2, according to the present invention.

As best seen in FIG. 3, a preferred embodiment of assembly 44 includes a rotatable field ion clearing electrode 46 ("RICE"), a positive ion electrode 48 ("PIE"), first and second ion clearing electrodes 50, 50' ("ICEs"), and a periodic axial field ion controlling electrode 52 ("PICE"). While FIG. 2 shows the present invention 44 used in conjunction with a relatively short housing 10, the present invention may also be used with conventional longer housings. Further, while FIG. 3 depicts assembly 44 as including a RICE, a PIE, two ICEs and a PICE, it is to be understood that the present invention may be implemented without all of these elements. For example, while the RICE 46 and PIE 48 normally will be present, the PICE 52 may be dispensed with where discontinuities are not present. Further, in systems where it is unnecessary to sweep away further ions, either or both of ICE 50, 50' may be dispensed with.

The various RICE, PIE, ICE and PICE elements comprising assembly 44 preferably are made from a relatively inert conducting material that does not outgas within chamber 10, stainless steel for example. Each RICE, PIE, ICE and PICE preferably is mounted within the chamber 10 using insulated standoffs 54, e.g., ceramic, as these elements are coupled to potential sources that create electric fields to which the electron beam 12 is subjected.

In the relatively short chamber system 8 with which the present invention may be used, the distance 56 from electron gun 32 to the focus coil 40 is only about 40 cm, contrasted with 1.5 m in the prior art systems with which the earlier Boyd, et al., Rand et al. patents were practiced. In these earlier systems, assembly 44 would have been a single prior art ICE, extending substantially the entire 1.5 meter distance from electron gun 32 to focus coil 40. In such systems, prior art ICEs would sweep away all ions, and the relatively large drift length allowed the electron beam space-charge density to become reasonably homogenous.

However in the present system 8, although approximately 40 cm distance is available for assembly 44, satisfactory performance is obtained with a RICE 46 whose length is about 17 cm. Rather than lengthen RICE 46 to the full electron gun-to-focus coil distance (40 cm) to control positive ions, positive ions may be essentially totally removed from the otherwise exposed regions of chamber 10 using ICE elements 50, 50'. If, as depicted in FIG. 2, one or more discontinuities such as 37 are present, it is advantageous to include the PICE 52, a relatively short length element that can operate over such discontinuities.

The elements comprising the assembly 44 depicted in FIG. 3 will now be described in detail. According to the present invention, RICE 46 preferably creates a rotatable electric field to which the electron beam 12 is subjected, and represents the most important component of the electrode assembly 44. As shown in FIGS. 3 and 4A, RICE 46 is generally conical shaped and includes at least two pair of cylindrically symmetrical elements 58A, 58B and 60A, 60B, each element being spaced apart from its opposing element symmetrically about the Z-axis 28. Thus in the embodiment of FIG. 3, two pair of elements are present, with elements 58A and 58B symmetrically spaced apart from each other about the Z-axis 28, and with elements 60A and 60B similarly spaced apart from each other.

Figure 4B:
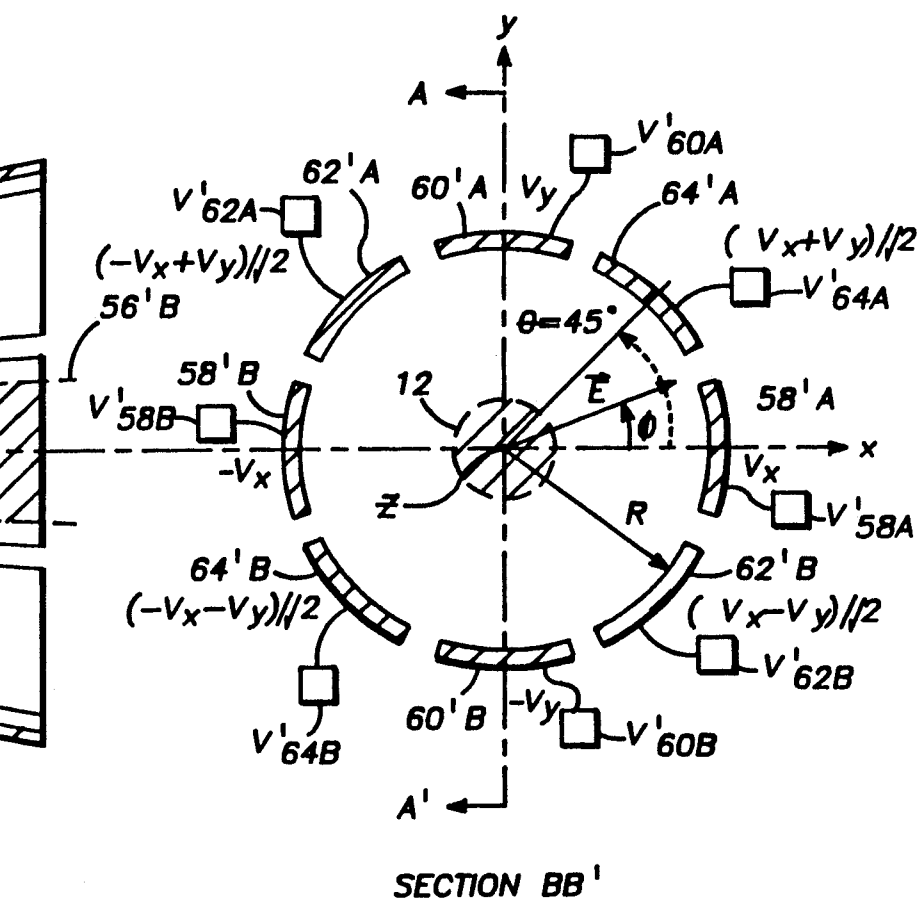
FIG. 4B is a sectional view of the RICE embodiment of FIG. 4A, taken along the section line B—B'.
Figure 4A:
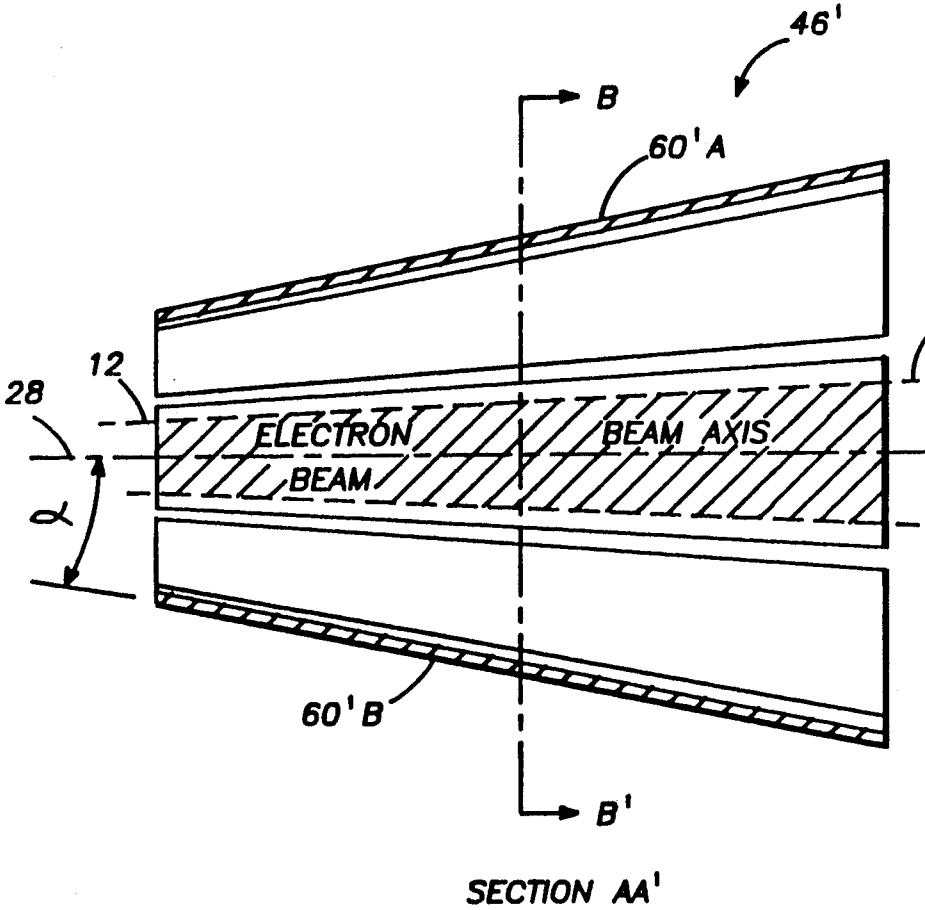
FIG. 4A is a longitudinal cross-sectional view of an alternative embodiment of a RICE comprising four element pairs.

Other RICE configurations are also possible, FIGS. 4A and 4B depicting, for example, a generally conical shaped RICE 46' comprising four element pairs 58A and 58B, 60A and 60B, 62A and 62B, and 64A and 64B. In the preferred embodiment of FIGS. 4A and 4B, the elements in each element pair are cylindrically symmetrical about the Z-axis 28 to each other. A RICE comprising more than four element pairs could also be employed. Although more elements improve the electric field uniformity, they increase the difficulty in routing the many electrode potentials to the RICE.

Each RICE embodiment 46, 46' is preferably conical shaped such that the ratio between the electrode radius (R) and the beam radius $r_o$ is constant. The generally conical geometry is significant because if $R/r_o \approx$ constant, then the electrical potential at the electron beam 12 axis is essentially constant. This means that positive ions trapped within the beam 12 will not drift axially, downstream or upstream. If this drift were not eliminated, positive ions within the beam would oscillate radially as they drifted, creating a severe non-uniform space-charge distribution, and beam optical aberrations. Since the electron beam 12 expands in the region in which the ion electrode assembly 44 or 44' is located, the RICE assembly 46, 46' has a generally cone shape that expands in the downstream direction. In the embodiment of FIGS. 4A and 4B, the RICE length is approximately 17 cm, and the slope angle o is approximately 3°. The upstream RICE diameter is approximately 4 cm, while the larger downstream RICE diameter is approximately 6 cm. While FIG. 3 and FIGS. 4A and 4B show conically shaped RICEs comprising curved elements, some or all of these elements could instead be planar as indicated by the phantom lines in FIG. 4B. One advantage of planar elements would be their relative ease of manufacture.

Each element in an element pair comprising the generically conical shaped RICE 46, 46' is coupled to a source of electrical potential, AC, DC or a combination thereof, that is preferably equal and opposite to the potential applied to the other element in the element pair. In FIG. 3, for example, element 58A is coupled to a potential source $V_{58A} = +V_x$, and element 58B, disposed diametrically opposite from element 58A, is coupled to a potential source $V_{58B} = -V_x$. The potential differential (i.e., $2\,V_x$) between these elements 58A, 58B creates a transverse electric field, and in a similar fashion the potential difference between each element in each element pair comprising the RICE creates a transverse electric field. The vector sum of these individual fields represents the electric field created by the RICE 46, the amplitude and direction of the resultant field being rotatable by varying one or more potentials applied to the element pairs. (Of course changing the RICE geometry mechanically also would affect the resultant electric field, but modifying the geometry in situ to get a sharply focused X-ray image would be more difficult.)

Regardless of how many electrode pairs a RICE comprises, several characteristics will preferably be present. The RICE will be generally conically shaped such that Z-axis potential differences within the electron beam are preferably minimized. The RICE will further exhibit cylindrical symmetry about the Z-axis, the better to present a more uniform field to the electron beam 12. Preferably equal and opposite potentials will be coupled to each element comprising a RICE element pair, to present a more uniform field to the electron beam 12. (A constant bias potential may also be applied to all electrodes.) Further, the potential applied to the electrodes is preferably computed geometrically as follows. If $V_x$ and $V_y$ represent electrode electrical potentials at the extreme X-axis and Y-axis electrode positions, then the potentials of the other electrodes take the general form:

$$V_i = V_x \times \cos\theta_i + V_y \times \sin\theta_i \qquad (1)$$

where $\theta_i$ is the average angle of electrode i. An electrode biasing scheme according to equation (1) will produce the most uniform electric field for a given number of electrodes. For example, in the embodiment of FIG. 3 where two pair of electrode elements are present, for elements 60A and 60B, $\theta \approx 90°$ and $\theta \approx 270°$ respectively, while for elements 58A and 58B, $\theta \ominus 0°$ and $\theta \approx 180°$ respectively. Therefore for a RICE 46 having two element pairs as shown in FIG. 3, the potentials applied to elements 58A, 58B, 60A and 60B are, per equation (1), respectively $+V_x$, $-V_x$, $+V_y$ and $-V_y$. By contrast, for the four element pair RICE 46' embodiment shown in FIGS. 4A and 4B, equation (1) requires that the potentials applied to elements 58'A, 58'B, 60'A, 60'B, 62'A, 62'B, and 64'A, 64'B (e.g., potentials $V_{48'A}$, $V_{58'B}$, etc.) have the values shown in Table 1, below. Electrode potentials for a RICE comprising a different number of electrode pairs would be similarly calculated using equation (1), above.

TABLE 1

| Element | ≈ Θ | Potential to Element |
|---|---|---|
| 58' A | 0° | $+V_x$ |
| 58' B | 180° | $-V_x$ |
| 60' A | 90° | $+V_y$ |
| 60' B | 270° | $-V_y$ |
| 62' A | 135° | $(-V_x + V_y)/\sqrt{2}$ |
| 62' B | 315° | $(V_x - V_y)/\sqrt{2}$ |
| 64' A | 45° | $(V_x + V_y)/\sqrt{2}$ |
| 64' B | 225° | $(-V_x - V_y)/\sqrt{2}$ |

The electric field produced by this arrangement is given by:

$$E = \frac{\sqrt{V_x^2 + V_y^2}}{R} \qquad (2)$$

where R is the electrode radius measured from the Z-axis. The vector orientation of the electric field E is given by $\phi$, where $$\tan(\phi)=V_y/V_x \quad (3)$$

As noted, by driving the RICE electrodes with DC potential, a static field having a desired magnitude and direction may be provided. However by driving the electrodes with an AC potential (or a DC potential including an AC component), a dynamically rotatable electric field is created. In addition to the above potentials, a constant negative potential may be applied to all electrodes without affecting the RICE-produced electric fields.

Figures 5A, 5B, 5C, 5D:
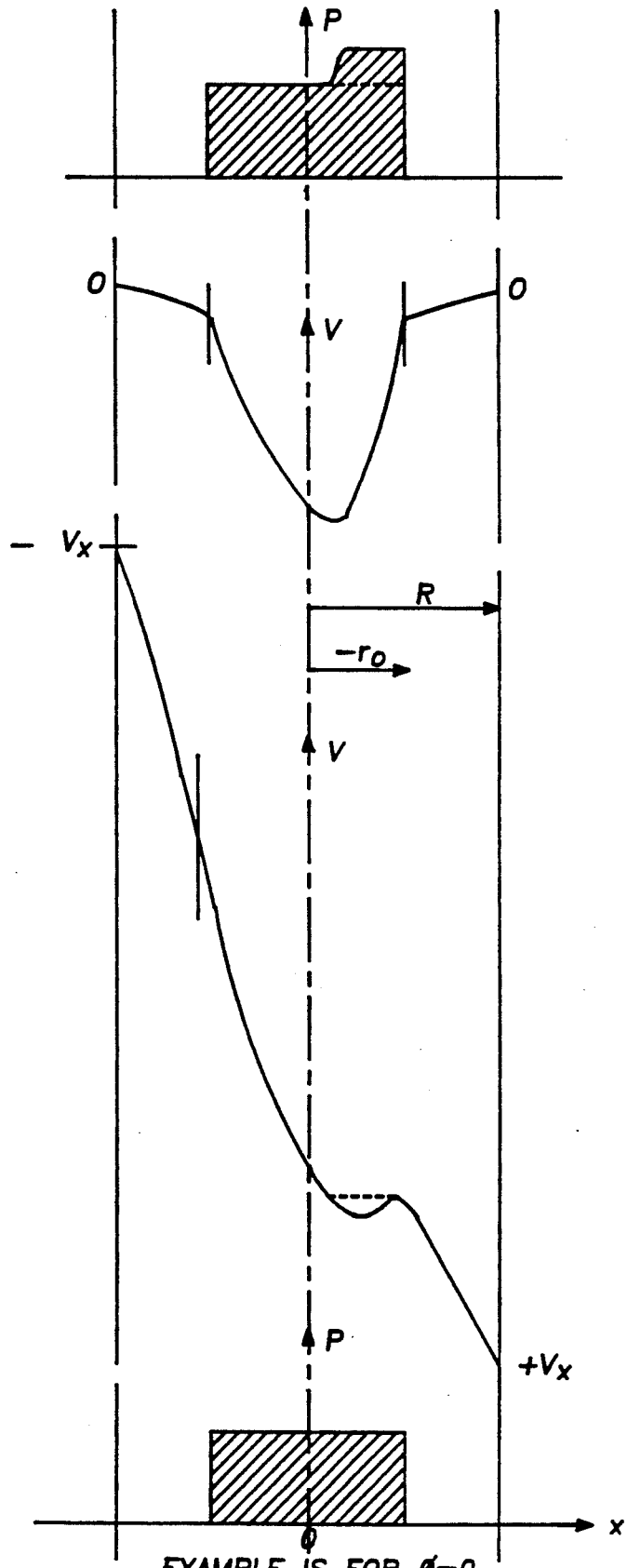
FIGS. 5A-5D depict correction of beam space-charge density resulting from an applied external corrective field created by a RICE, according to the present invention.
Figure 6A:
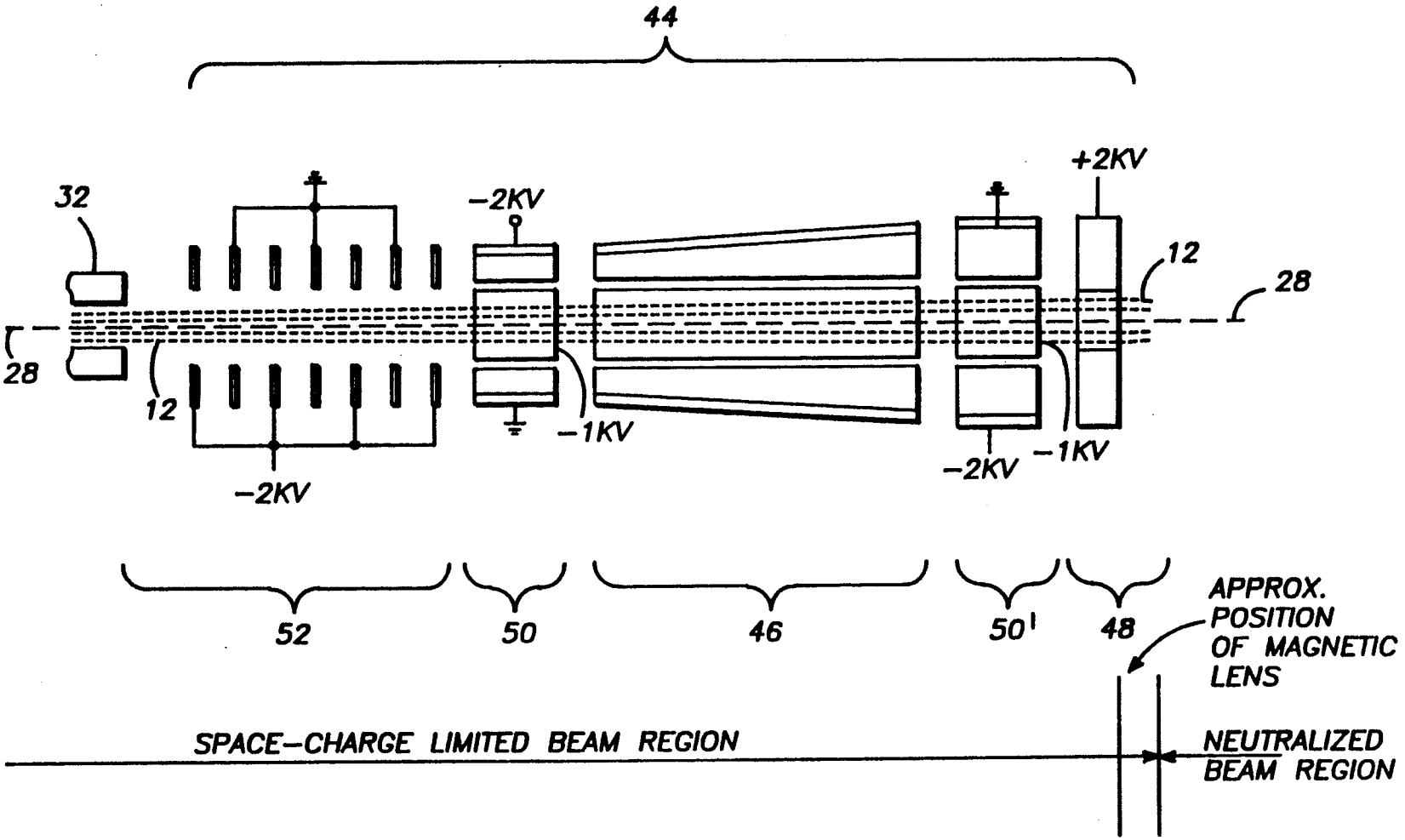
FIG. 6A is a longitudinal cross-sectional view of the electrode assembly 44 depicted in FIG. 3.
Figures 6B, 6C, 6D:
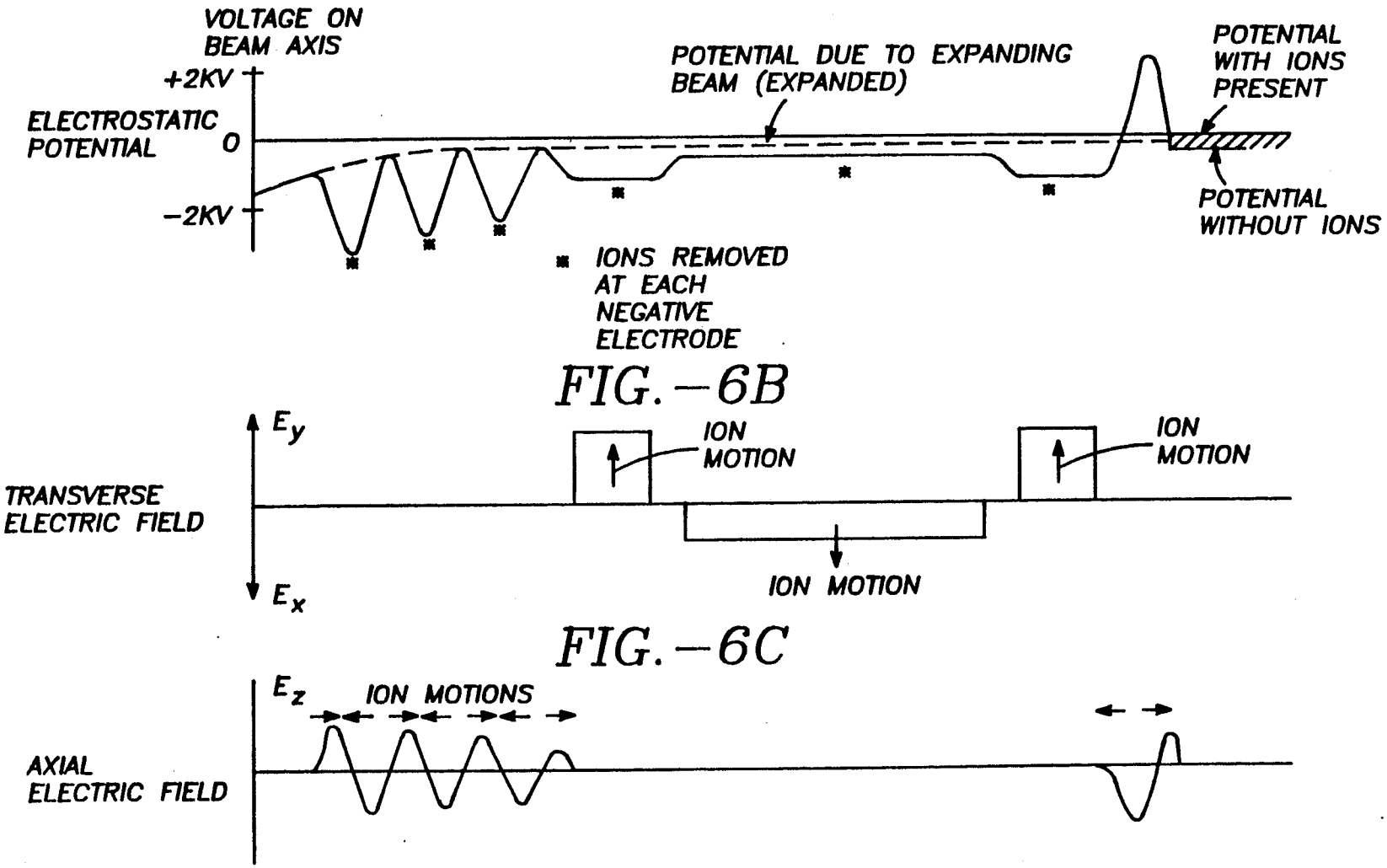
FIGS. 6B-6D depict electrostatic potential, transverse electric field and axial electric field at various longitudinal positions along assembly 44.

The method of improving beam space-charge density using a controllable RICE transverse field will now be described. FIG. 5A depicts a hypothetical non-uniform space-charge distribution ($\rho$) for an electron beam having radius $r_o$ that is coaxial with RICE electrode member pairs having a radius R (e.g., the electrode pairs of FIG. 4A, for example), for the case $\phi=0°$, i.e., $V_y=0$. The distribution depicted in FIG. 5A is non-uniform in that a pedestal exists, the right side of the beam showing higher space-charge density than the left side. This non-uniformity could result from positive ions, from non-linear effects caused by the beam optics assembly 38, or from other causes. By contrast, a uniform distribution is shown in phantom in FIG. 5A, representing the ideal case.

A design goal of the present invention is for system 8 to produce an electron beam 12 whose space-charge density has improved uniformity, If the intrinsic space-charge density for the electron beam is as shown in FIG. 5A, then the present invention should reduce the excess space-charge density on the right side of the beam. A more uniform beam space-charge density (e.g., a space-charge density distribution approaching the distribution shown in phantom in FIG. 5A) reduces aberrations that would impair resolution of the X-ray image seen on monitor 26.

FIG. 5B depicts the potential (V) distribution across the electron beam, and external to the beam but within the surrounding electrode. As such, FIG. 5B corresponds to the distribution of FIG. 5A and represents the potential that would be detected by a suitable probe monitoring the region encompassed by a RICE 46, or 46' according to the present invention. Within a uniform electron beam, the potential (V) distribution of FIG. 5B would be given by the equation:

$$V=-\frac{\eta_o I}{\beta}\times\left[1-\left(\frac{r}{r_o}\right)^2+2\times\ln\frac{R}{r_o}\right] \quad (4)$$

where $$\eta_o=\frac{1}{4\times\pi\times\epsilon_o\times c}\approx 30\ \Omega$$

and where I is the beam current, and $\beta$ is the speed of the electrons divided by the speed of light.

Taking the first derivative of equation (4) with respect to radial distance r yields the electric field due to the beam, (E) as follows:

$$E=\frac{2\eta_o I}{\beta}\times\frac{r}{r_o^2} \quad (5)$$

The electric potential (V) according to equation (4) is symmetrical with respect to distance r, but the effect of the space-charge non-uniformity is to skew the potential distribution as shown in FIG. 5B.

A RICE according to the present invention modifies the skewed potential distribution by imposing a transverse electric field ($E_{correction}$) the electron beam. This field is rotated (preferably by adjusting potentials to the elements comprising the RICE) until $E_{correction}$ is in the direction of the non-uniformity. The magnitude of the rotatable field is approximately:

$$E_{correction}\approx\frac{2\eta_o I}{\beta r_o}$$

$E_{correction}$ produces a potential (V) distribution across the electron beam and RICE electrodes as shown in FIG. 5C, with a shallow minimum (or potential well) on the right side of the beam. Because the positive ions in chamber 10 have a potential energy less than the potential well depth shown in FIG. 5C, the ions tend to accumulate and remain trapped in the well until electrostatic equilibrium is reached. The potential then follows the phantom or dashed line drawn in FIG. 5C. Thus positive ions trapped in the potential well reduce the effective space-charge density on the right side of the electron beam, which is precisely the correction needed to flatten out the non-uniform distribution of FIG. 5A. The net result is an electron beam with a more uniform space-charge distribution, as shown in FIG. 5D. Thus, aberrations due to an electron beam space-charge density corresponding to FIG. 5A are corrected. In general, correction of the space-charge distribution may not always be as exact as shown in FIG. 5. However aberrations due to a non-uniform distribution can always be reduced using a RICE, according to the present invention.

In practice, the field $E_{correction}$ required to homogenize an electron beam can be readily provided, about 60 V/cm being required to homogenize an electron beam having a 1 cm radius, 600 mA beam current, 130 kV electron gun potential, where $\beta\approx 0.6$. The resultant RICE field is approximately the same order of magnitude as the field produced by the electron beam itself, as contrasted with the extremely large field produced by a prior art ICE. A system 10 equipped with an electrode assembly 44 according to the present invention can produce an electron beam whose radius ($r_o$) is about 2 mm at the electron gun 32 and about 1 cm at the focus coil 40. At the target 14, the beam 12 is preferably sharply focused into an ellipse whose minor axis is about 1 mm or less, and whose major axis is about five to ten times larger.

As noted, the potentials applied to the elements in a RICE may be DC, AC or a combination thereof. Starting point values for $V_x$ and $V_y$ for the RICE embodiment of FIG. 3 tend to be between about ±300 V to about ±600 V, which is substantially lower than the potentials required by a conventional prior art ICE. The $V_x$, $V_y$ voltages (and other electrode voltages if the RICE has additional electrode pairs) are adjusted so that the highest resolution X-ray image is achieved. In some applications (e.g., system 8), operation of the RICE in a dynamic mode may be desirable. In this mode, the RICE element potentials preferably include an AC component synchronized to the signal that drives the beam optics 38. This dynamic mode is indicated by the phantom line 64 in FIG. 2. A statically driven RICE according to the present invention can produce a satisfactory beam distribution and resultant X-ray image for system 8. However, dynamically driving the RICE can provide corrections that vary the magnitude and direction of $E_{correction}$ to account for the scanning electron beam and the fact that optimal aberration correction may be a function of the direction of beam deflection.

FIG. 3 also depicts an assembly 44 according to the present invention as including a positive ion electrode ("PIE") 48, disposed coaxially downstream from the RICE 46. The PIE 48 is preferably a planar washer whose center opening is at least as large as the beam diameter at that region, typically about 1.5 cm. PIE 48 is preferably coupled to a large positive potential (e.g., +2 kV) $V_{48}$. The resultant large axial PIE field prevents positive ions from migrating upstream toward and into the RICE. Such upstream migration would be detrimental and could interfere with the production of a sharply self-focused uniform beam at the X-ray target. A PIE 48 according to the present invention also serves to sharply define where the downstream field effects created by assembly 44 terminate.

FIG. 3 also depicts assembly 44 as including optional ICE elements 50, 50', which ICEs are preferably similar to those disclosed in U.S. Pat. No. 4,625,150 to Rand, et al. Each ICE 50, 50' preferably comprises two separate element pairs, forming a constant radius cylinder. ICE 50 comprises diametrically opposing element pairs 66A, 66B, and 68A and 68B, and in similar fashion, ICE 50' comprises elements 66'A, 66'B, 68'A and 68'B. As shown in FIG. 3, ICE 50's elements 66A, 66B, 68A and 68B are coupled, respectively, to potential sources $V_{66A}$, $V_{66B}$, $V_{68A}$ and $V_{68B}$, and the elements of ICE 50', 66'A, 66'B, 68'A and 68'B are respectively coupled to potential sources $V'_{66A}$, $V'_{68B}$, $V'_{68A}$ and $V'_{68B}$. As disclosed in the above patent to Rand, et al., by suitably selecting the magnitudes of the potential sources to which the ICE electrodes are coupled, ICEs 50, 50' can be made to sweep away positive ions, while maintaining a uniform electric field.

Accordingly, it is preferred that $V_{68A} \approx V'_{68A} \approx -1.5$ kV, $V_{68B} \approx V'_{68B} \approx 0$ V (e.g., ground), $V_{66A} \approx V_{66B} \approx V'_{66A} \approx V'_{66B} \approx 0.5(V_{68A}) \approx -750$ V. $V'_{68A}$ and $V'_{68B}$ may also be reversed. Potential $V_{68A}$ could, however, be other than −1.5 kV, with the other electrode potentials being changed accordingly.

ICEs 50 and/or 50' may not be required in all applications. Essentially, such ICEs represent an economical design approach to removing ions over regions of housing chamber 10 where it is not necessary to extend the length of a RICE 46 or (if present) a PICE 52. In the preferred embodiment of FIG. 3, each ICE 50, 50' is about 7 cm in length, although different lengths could be used. Preferably ICEs 50, 50' each have an outside diameter of about 5 cm. In essence, these optional ICEs function as described in the above patent to Rand, et al., to sweep away ions while maintaining a uniform electric field.

The periodic axial field ion clearing electrode, PICE 52, depicted in FIG. 3 will now be described. PICE 52 is disposed within the upstream end of assembly 44, adjacent the electron gun 32. The PICE 52 preferably comprises a plurality of disk-like elements 70, 72 spaced apart coaxially along the Z-axis 28. Alternate electrodes, e.g., 70, 70A, 70B, 70C are together coupled to a first potential source $V_{70}$ and the intermediate electrodes, e.g., 72, 72A, 72B are together coupled to a second potential source $V_{72}$. In the preferred embodiment of FIG. 3, seven disks are used, and $V_{70} \approx -2$ kV and $V_{72} \approx 0$ V (e.g., ground), although other potentials could be used, including possibly +2 kV and ground. A design consideration for the PICE is that within a relatively short lateral distance, e.g., about 5 cm, a sufficiently high rate of change of axial potential must be created to rapidly remove ions. The potentials $V_{70}$, $V_{72}$, like the potentials coupled to the RICE 46, PIE 48, and ICEs 50, 50', are sufficient to create the desired field but in contrast to the −130 kV electron gun potential are not sufficient to disturb the electron beam flow.

FIGS. 6A–6D depict assembly 44 in longitudinal cross-section, and the fields created by the RICE 46, PIE 48, ICEs 50, 50' and PICE 52.

Modifications and variations may be made to the disclosed embodiments without departing from the subject and spirit of the invention as defined by the following claims. For example, although an ion controlling electrode assembly has been described with reference to a beam scanning computed tomography X-ray system, the present invention may also be used in other environments where it is necessary to produce a more homogenized electron beam space-charge density within a given region.

What is claimed is:

1. An electrode assembly for correcting space-charge density non-uniformity in an electron beam generated in a vacuum housing chamber containing a low pressure gas from which positive ions may be created, the electron beam traveling in a downstream direction defining a Z-axis, the assembly being disposed substantially coaxially with the electron beam along the Z-axis and comprising:

first and second members, spaced-apart diametrically relative to the Z-axis, defining a first electrode pair;

third and fourth members, spaced-apart diametrically relative to the Z-axis, defining a second electrode pair;

means for coupling said first, second, third and fourth members respectively to first, second, third and fourth potential sources;

said potential sources creating a potential difference between said members comprising each said electrode pair causing each said electrode pair to create an electric field;

the assembly producing a resultant electric field equal to the vector sum of each said electric field created by each said electrode pair;

wherein said resultant electric field is controllably rotated, by varying chosen ones of said potential sources, to an orientation controllably removing sufficient positive ions to compensate for space-charge density non-uniformity in said beam.

2. The assembly of claim 1, wherein:

said first and second potentials are substantially equal and opposite; and said third and fourth potentials are substantially equal and opposite.

3. The assembly of claim 1, wherein relative to said Z-axis each said member defines a radius R, and said beam defines a radius $r_o$, where a ratio defined by $R/r_o$ is substantially constant;

said $R/r_o$ ratio substantially eliminating a voltage gradient along said Z-axis, minimizing positive ion migration and attendant non-uniform space-charge distribution in said beam.

4. The assembly of claim 1, wherein said members comprising each said electrode pair are substantially cylindrically symmetrical about said Z-axis to each other.

5. The assembly of claim 1, further including:

at least two additional members comprising at least a third electrode pair;

means for coupling a source of potential to each said additional member;

the potential $V_i$ applied to each member in the assembly being:

$$V_i = V_x \times \cos\theta_i + V_y \times \sin\theta_i$$

where $\theta_i$ is the average angle of member i, and where $V_x$ and $V_y$ respectively represent potential applied at an extreme X-axis and Y-axis member position, said X-axis and Y-axis being mutually orthogonal and defining a plane normal to said Z-axis.

6. The assembly of claim 1, wherein at least said first and second members are planar.

7. The assembly of claim 1, further including:

a planar disk element defining a central opening sized to permit passage of said beam therethrough, disposed coaxial with said Z-axis downstream from said assembly; and means for coupling said planar disk to a source of positive potential sufficient to create an axial field blocking upstream migration of positive ions toward said assembly.

8. The assembly of claim 1, further including:

a plurality of planar disk elements, each defining a central opening sized to permit passage of said beam therethrough, spaced-apart and disposed coaxial with said Z-axis upstream from said assembly;

means for coupling alternate ones of said planar disk elements to a first source of disk potential; and means for coupling intermediate ones of said planar disks to a second source of disk potential;

wherein a potential difference between said first and second sources of disk potential creates an alternating axial field between adjacent ones of said planar disks such that substantially all positive ions created within or near said disks are swept away.

9. The assembly of claim 1, further including an ion clearing electrode comprising:

first, second, third and fourth electrodes forming a constant radius cylinder, symmetrically disposed coaxially with said Z-axis;

means for coupling said first, second, third and fourth electrodes respectively to first, second, third and fourth electrode potential sources;

said second and third electrode potential sources each being approximately half of said first electrode potential source, and said fourth electrode potential source being substantially zero;

wherein said electrodes establish a substantially uniform electric field while sweeping away positive ions created therein or nearby.

10. An electrode assembly for correcting space-charge density non-uniformity in an electron beam generated in a vacuum housing chamber containing a low pressure gas from which positive ions may be created, the beam traveling in a downstream direction defining a Z-axis, the assembly being disposed substantially coaxially with the electron beam along the Z-axis and comprising:

at least two pairs of electrodes, each electrode pair comprising two members that are spaced-apart diametrically relative to the Z-axis and are substantially cylindrically symmetrical to each other about said Z-axis;

means for coupling said members to potential sources such that the potential $V_i$ applied to each member in the assembly is:

$$V_i = V_x \times \cos\theta_i + V_y \times \sin\theta_i$$

where $\theta_i$ is the average angle of member i, and where $V_x$ and $V_y$ respectively represent potential applied at an extreme X-axis and Y-axis member position, said X-axis and Y-axis being mutually orthogonal and defining a plane normal to said Z-axis;

wherein relative to said Z-axis, the electron beam defines a radius $r_o$ and each electrode pair defines a radial distance R, such that a ratio defined by $R/r_o$ is substantially constant;

said $R/r_o$ ratio substantially eliminating any voltage gradient along said Z-axis with the result that positive ions within said electrode assembly will not migrate along said Z-axis;

the assembly producing a resultant electric field equal to the vector sum of fields produced between each electrode pair;

wherein varying chosen ones of said $V_i$ potential permits controllably rotating said resultant electric field to an orientation causing removal of sufficient positive ions to compensate for space-charge density non-uniformity in said beam and permits said electron beam to focus sharply upon a desired target.

11. The assembly of claim 10, wherein at least one of said at least two pairs of electrodes is planar.

12. The assembly of claim 10, further including:

a planar disk element defining a central opening sized to permit passage of said beam therethrough, disposed coaxial with said Z-axis downstream from said assembly; and means for coupling said planar disk to a source of positive potential sufficient to create an axial field blocking upstream migration of positive ions toward said assembly.

13. The assembly of claim 10, further including:

a plurality of planar disk elements, each defining a central opening sized to permit passage of said beam therethrough, spaced-apart and disposed coaxial with said Z-axis upstream from said assembly;

means for coupling alternate ones of said planar disk elements to a first source of disk potential; and means for coupling intermediate ones of said planar disks to a second source of disk potential;

wherein a potential difference between said first and second sources of disk potential creates an alternating axial field between adjacent ones of said planar disks such that substantially all positive ions created within or near said disks are swept away.

14. The assembly of claim 10, further including an ion clearing electrode comprising:

first, second, third and fourth ion clearing electrodes forming symmetrical segments of a constant radius cylinder, said electrodes being symmetrically disposed coaxially with said Z-axis such that, relative to said Z-axis, said first and fourth electrodes are diametrically opposed and said second and third electrodes are diametrically opposed;

means for coupling said first, second, third and fourth electrodes respectively to first, second, third and fourth electrode potential sources;

said second and third electrode potential sources each being approximately half of said first electrode potential source, and said fourth electrode potential source being substantially zero;

wherein said electrodes establish a substantially uniform electric field while sweeping away positive ions attempting to pass longitudinally therethrough.

15. In a computed tomography X-ray scanning system, an electron beam production and control system for producing X-rays, said system comprising:

an evacuated housing chamber having an upstream end, a downstream end, and defining a Z-axis extending therebetween, and further containing a low pressure gas from which positive ions may be created;

means, disposed within said upstream end of said chamber, for producing an electron beam and directing said beam in a downstream direction at least initially along said Z-axis;

means for correcting space-charge density non-uniformity of said electron beam by subjecting at least a portion of said electron beam to a rotatable electric field that controllably removes positive ions, said means being disposed substantially coaxially with said electron beam along said Z-axis;

a stationary target, disposed within the downstream end of said chamber for emitting X-rays upon impingement by said electron beam;

means for deflecting and focusing said electron beam upon said target;

wherein said means for correcting promotes production of a more sharply focused electron beam upon said target than if said means for correction were not used.

16. The system of claim 15, wherein said upstream end of said chamber and said means for deflecting and focusing are separated; by less than about 50 cm.

17. The system of claim 16, wherein said means for correcting includes:

at least two pair of electrodes, each electrode pair comprising two members that are spaced-apart diametrically relative to the Z-axis and are substantially cylindrically symmetrical to each other about said Z-axis;

means for coupling said members to potential sources such that the potential $V_i$ applied to each member in the assembly is:

$$V_i = V_x \times \cos\theta_i + V_y \times \sin\theta_i$$

where $\theta_i$ is the average angle of member i, and $V_x$ and $V_y$ respectively represent potentials applied at an extreme X-axis and Y-axis member position, said X-axis and Y-axis being mutually orthogonal and defining a plane normal to said Z-axis;

wherein relative to said Z-axis, said electron beam defines a radius $r_o$ and each said electrode pair defines a radial distance R, such that a ratio defined by $R/r_o$ is substantially constant;

said $R/r_o$ ratio substantially eliminating any voltage gradient along said Z-axis with the result that positive ions within said electrode assembly will not migrate along said Z-axis;

the assembly producing a resultant electric field equal to the vector sum of fields produced between each electrode pair;

wherein varying chosen ones of said $V_i$ potential permits controllably rotating said resultant electric field to an orientation causing removal of sufficient positive ions to compensate for space-charge density non-uniformity in said beam and permits said electron beam to focus sharply upon a desired target.

18. The system of claim 15, further including:

a planar disk element defining a central opening sized to permit passage of the electron beam therethrough, disposed coaxial with said Z-axis downstream from said means for correcting; and means for coupling said planar disk to a source of positive potential sufficient to create an axial field blocking upstream migration of positive ions toward said means for correcting.

19. The system of claim 15, further including:

alternating axial field means for sweeping away positive ions in a region of said housing chamber that includes a discontinuity.

20. The system of claim 19, wherein said alternating axial field means includes:

a plurality of planar disk elements, each defining a central opening sized to permit passage of said beam therethrough, spaced-apart and disposed coaxial with said Z-axis upstream from said means for correcting;

means for coupling alternate ones of said planar disk elements to a first source of disk potential; and means for coupling intermediate ones of said planar disks to a second source of disk potential;

wherein a potential difference between said first and second sources of disk potential creates an alternating axial field between adjacent ones of said planar disks such that substantially all positive ions created within or near said disks are swept away.

21. The system of claim 15, further including an ion clearing electrode disposed within a region of said housing chamber, said ion clearing electrode comprising:

first, second, third and fourth ion clearing electrodes forming symmetrical segments of a constant radius cylinder, said electrodes being symmetrically disposed coaxially with said Z-axis such that, relative to said Z-axis, said first and fourth electrodes are diametrically opposed and said second and third electrodes are diametrically opposed;

means for coupling said first, second, third and fourth electrodes respectively to first, second, third and fourth electrode potential sources;

said second and third electrode potential sources each being approximately half of said first electrode potential source, and said fourth electrode potential source being substantially zero;

wherein said electrodes establish a substantially uniform electric field while sweeping away positive ions attempting to pass longitudinally therethrough or created therein.

* * * * *